US005282891A

United States Patent [19]

Durham

[11] Patent Number: 5,282,891

[45] Date of Patent: Feb. 1, 1994

[54] HOT-SIDE, SINGLE-STAGE ELECTROSTATIC PRECIPITATOR HAVING REDUCED BACK CORONA DISCHARGE

[75] Inventor: Michael D. Durham, Castle Rock, Colo.

[73] Assignee: ADA Technologies, Inc., Englewood, Colo.

[21] Appl. No.: 877,670

[22] Filed: May 1, 1992

[51] Int. Cl.[5] ..... B03C 3/41

[52] U.S. Cl. ..... 96/75; 96/97; 96/98

[58] Field of Search ..... 55/2, 11, 101, 134, 55/135, 138, 139, 146, 152, 157

[56] References Cited

U.S. PATENT DOCUMENTS

| | | | |
|---|---|---|---|
| 2,694,464 | 11/1954 | Wintermute | 55/157 X |
| 3,495,379 | 2/1970 | Hall et al. | 55/157 X |
| 4,077,782 | 3/1978 | Drummond et al. | 55/139 |
| 4,216,000 | 8/1980 | Kofoid | 55/138 |
| 4,233,037 | 11/1980 | Pontius et al. | 55/2 |
| 4,375,364 | 3/1983 | Van Hoesen et al. | 55/152 |
| 4,431,434 | 2/1984 | Rinard et al. | 55/135 |
| 4,518,401 | 5/1985 | Pontius et al. | 55/101 |
| 5,066,313 | 11/1991 | Mallory, Sr. | 55/152 X |

OTHER PUBLICATIONS

K. McLean, "Electrical Characteristics of Large-Diameter Discharge Electrodes in Electrostatic Precipitators", Proceedings: Fifth Symposium on the Transfer and Utilization of Particulate Control Technology, Industrial Environmental Research Institute, U.S. Environmental Protection Agency, vol. 2, pp. 23-1 to 23-11 (1986).

H. White, "Industrial Electrostatic Precipitation", pp. 90 to 101 (1963).

R. E. Bickelhaupt, "An Interpretation of the Deteriorative Performance of Hot-Side Precipitators", *Journal of the Air Pollution Control Association*, vol. 30, No. 8, pp. 882-888, Aug., 1980.

ASME, "Determining the Properties of Fine Particulate Matter", §4.05, pp. 15-37 (1965).

IEEE Standard 548-1981 Guidelines for the Laboratory Measurement and Reporting of Fly Ash Resistivity, pp. 7-30 (1981).

*Primary Examiner*—Richard L. Chiesa

*Attorney, Agent, or Firm*—Sheridan Ross & McIntosh

[57] ABSTRACT

An improved hot-side electrostatic precipitator is provided which more efficiently removes particulates such as fly ash from gases by substantially decreasing the occurrence of back corona discharge. The improved hot-side electrostatic precipitator is based upon the discovery that back corona discharge occurs primarily, if not entirely, in the accumulated particle layer in those sections of the collection plates having a temperature low enough to initiate back corona discharge.

Based on this recognition, the corona electrodes and collection plates of the present invention define an upper laterally extending primary operating region having a temperature substantially throughout that is greater than a first value and having at least a portion with a localized electric field strength in the primary operating region greater than a second value, and a lower laterally extending secondary operating region having a temperature substantially throughout that is less than the first value and a localized electric field strength substantially throughout that is less than the second value. The first and second values are selected so that the likelihood of back corona discharge is reduced.

24 Claims, 8 Drawing Sheets

FIG. 8
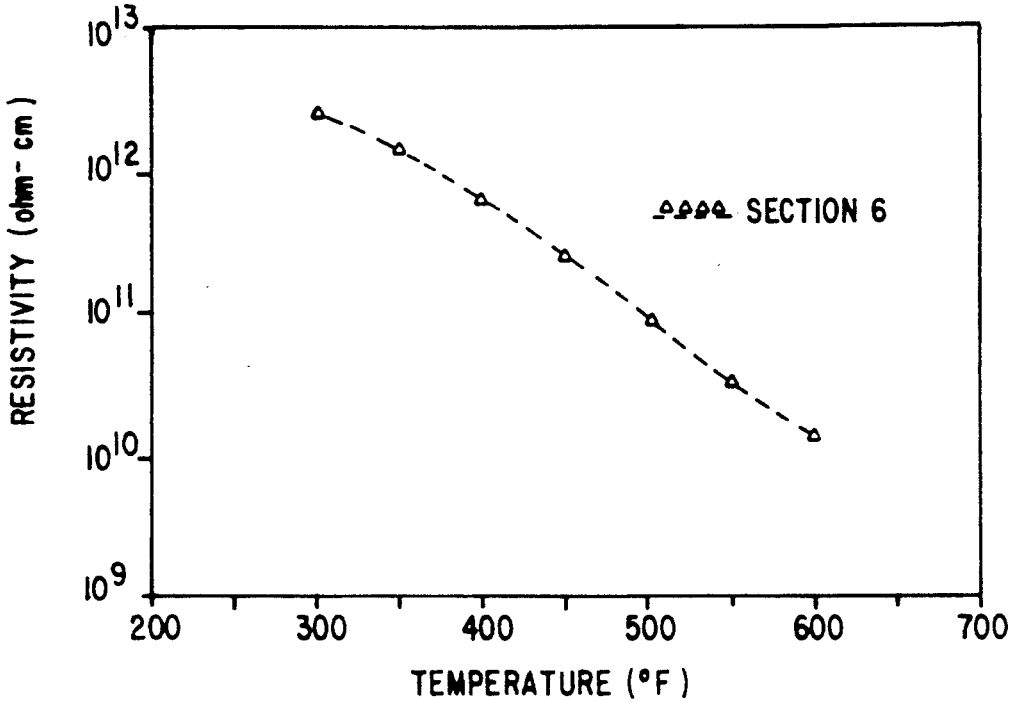
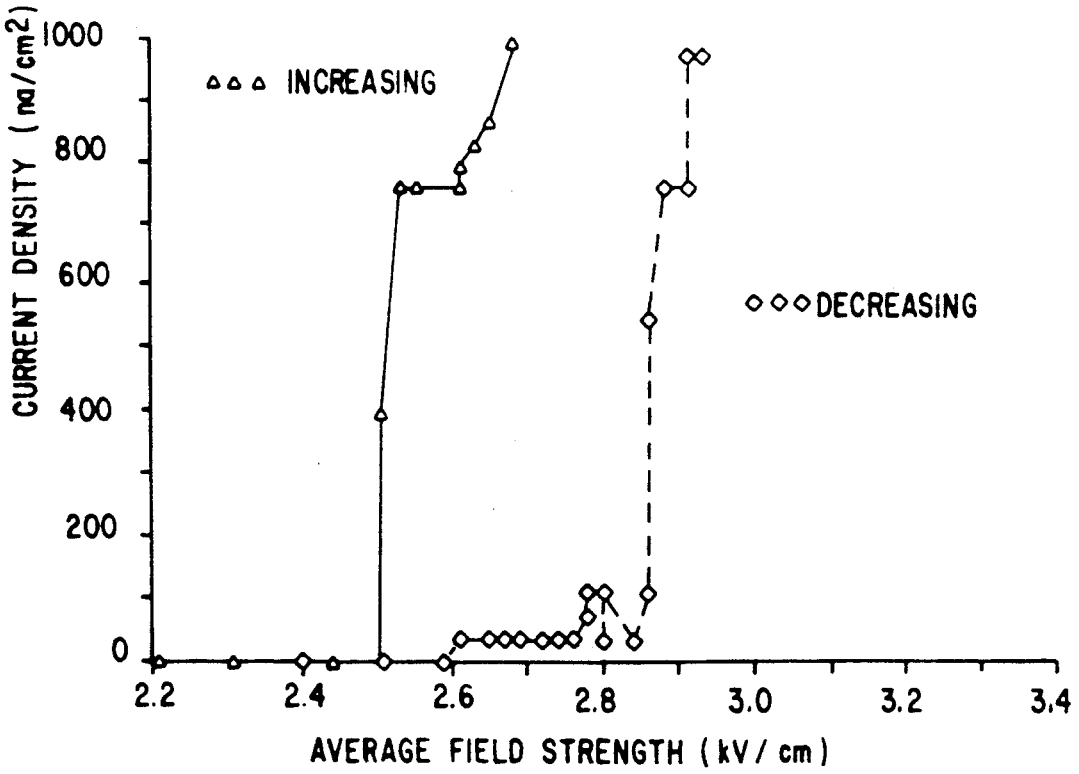
FIG. 9

HOT-SIDE, SINGLE-STAGE ELECTROSTATIC PRECIPITATOR HAVING REDUCED BACK CORONA DISCHARGE

FIELD OF THE INVENTION

The present invention relates to an improved hot-side, single-stage electrostatic precipitator which more efficiently removes particulates such as fly ash or spent catalyst from gases by reducing the occurrence of back corona discharge.

BACKGROUND OF THE INVENTION

Environmental standards for particle emissions by coal-fired electrical power plants, petroleum refineries, chemical plants, pulp and paper plants, cement plants, and other particulate-emitting facilities are becoming increasingly more demanding. For example, air quality standards in the United States now require power plants to remove more than 99 percent of the fly ash produced by coal combustion before flue gas may be discharged into the atmosphere. As environmental standards tighten, there is a corresponding need for a more efficient means of particulate removal, particularly in the case of coals having high ash content.

The electrostatic precipitator is a commonly used device for the removal of particles from the exhaust gases produced by the above-noted facilities. There are two primary types of electrostatic precipitators. In the single-stage electrostatic precipitator, the particle-laden gas passes negatively charged corona electrodes which impart a negative charge to the particles. The charged particles then migrate towards positively charged collection plates alternately positioned between the corona electrodes and parallel to the direction of the gas flow. The particles accumulate on the collection plates and are removed by various techniques for disposal.

The two-stage electrostatic precipitator has separate charging and collecting stages. In the charging stage, a series of negatively charged corona electrodes impart a negative charge to the particles. In the collection stage, the negatively charged particles pass through an electric field which causes the charged particles to migrate towards a series of positively charged collection plates. The particles accumulate on the collection plates and are removed by various techniques for disposal. The primary difference between single- and two-stage electrostatic precipitators is that the former combines both the charging stage and the collection stage into a single unit whereas the latter separates the two stages into independent units.

Single- and two-stage electrostatic precipitators are further classified as "hot" and "cold"-side electrostatic precipitators. As used herein, "hot-side electrostatic precipitator" refers to any electrostatic precipitator, whether used by a power plant, petroleum refinery, chemical plant, pulp and paper plant, cement plant, or otherwise, that operates at temperatures above the critical temperature of the particles to be removed, while "cold-side electrostatic precipitator" refers to any electrostatic precipitator operating below the critical temperature of the particles. "Critical temperature" refers to the temperature at which a particle has its highest resistivity to electrical current. By way of example, FIG. 1 illustrates the critical temperature for typical fly ash particles found in utility gas streams. The relationship between particle temperature and particle resistivity exemplified by FIG. 1 exists for other particles treated by electrostatic precipitators, although the precise shape and position of the curve may vary. At temperatures above the critical temperature, particle resistivity is predominantly determined by the chemical composition of the particles and is generally independent of gas characteristics. This relationship between particle resistivity and particle composition makes the particle resistivity inversely proportional to particle temperature. At temperatures below the critical temperature, or in the operating region for cold-side electrostatic precipitators, particle resistivity is predominantly dependent upon the interaction between the particles and the condensable vapors in the gas, such as water and sulfuric acid. This interaction makes resistivity directly proportional to particle temperature.

The efficiency of single-stage electrostatic precipitators is determined to a large extent by the maximum permissible magnitudes of operating voltage and electrical current between the corona electrodes and collection plates. The operating voltage principally determines the strength of the electric field between the corona electrodes and the collection plates and thereby largely establishes the magnitude of the charge imparted to the particles and drawing capability of the collection plates. The corona current, i.e., the flow of ions from the corona electrodes to the collection plates, determines the rate at which particles are charged. Thus, the greater the operating voltage and electrical current, the greater the potential particle removal efficiency of the electrostatic precipitator. Such efficiency is limited, however, by the operating voltage and corona current levels associated with back corona discharge or sparkover occurring in the accumulated particle layer on the collection plates.

Back corona discharge is a phenomena which occurs when the localized electric field generated in the interparticle void spaces in the accumulated particle layer by the ions collecting in the particle layer exceeds the electrical breakdown strength of the gas contained in the interparticle void spaces. As used herein, "localized electric field" refers to the electric field produced by a specified source in a designated area. At higher resistivities of the accumulated particles, the layer becomes more resistant to the flow of negative ions to the positively charged collection plates and the strength of the localized electric field produced in the interparticle void spaces by the charges or ions in the accumulated particle layer correspondingly increases.

When the electric field produced by the accumulated particle layer exceeds the electrical breakdown strength of the accumulated particle layer, i.e., the breakdown strength of the gas in the void spaces between the particles in the accumulated particle layer, electrical energy stored in the accumulated particle layer is discharged, causing an electrical sparkover from the particle layer to the corona electrode and/or reverse ionization. The electrical breakdown strength of the accumulated particle layer is a function of particle size and shape, particle packing density in the accumulated particle layer, and the composition and density of the gas in the interparticle void spaces. In this regard, it is important to understand that the present inventors believe that the onset of back corona discharge is largely unrelated to the thickness of the accumulated particle layer but that the thickness of the accumulated particle layer is directly related to the magnitude of the back corona discharge.

Sparkover caused by back corona discharge limits the operating voltage. Reverse ionization back corona discharge creates a crater in the accumulated particle layer thereby causing a release of positively charged ions into the space between the collection plate and corona electrode. The positively charged ions neutralize the charge on particles produced by negatively charged ions emanating from the corona electrode, resulting in a drain of the operating current and thus a lower operating voltage. As a result, particles receive an inadequate charge to draw them to the collection plates and a greater percentage are discharged into the atmosphere.

The deterioration of efficiencies in hot-side electrostatic precipitators has been studied extensively since efficiency problems began to surface in the late 1970's. The theory most widely recognized in attempting to address the problem is the sodium depletion theory developed by the Southern Research Institute. R. E. Bickelhaupt, *Influence of Fly Ash Compositional Factors on Electrical Volume Resistivity*, EPA-650/2-74-074 (July 1974). This theory suggests that sodium ions migrate away from the accumulated particle layer nearest the collection plate towards the outer accumulated particle layer boundary. The migration is believed to result in a build-up of a particularly high-resistivity layer in the accumulated particles nearest the collection plates which restricts the flow of negatively charged ions to the plates. Based on the sodium migration theory, a variety of measures have been implemented, including (i) reversing the polarity of the corona electrode and collection plate to reverse the sodium migration; (ii) doping the collection plate with a sodium-based compound; and (iii) increasing the sodium content of the fly ash.

Other methods used in an attempt to decrease the incidence of back corona discharge include: (i) increasing the rapping frequency and intensity or using sonic horns to remove accumulated particles from the collection plates and reduce the thickness of the accumulated particle layer; (ii) energizing the corona electrode in pulses; (iii) using heating devices to adjust the temperature of the input gas and the entire length of the collection plates; (iv) altering the current density in the collection plates along the entire length of the corona electrode; and (v) converting a hot-side electrostatic precipitator to a cold-side electrostatic precipitator. All of the above measures have met with varying degrees of success and none have proven to yield a reliable and practical solution to the efficiency problems plaguing hot-side electrostatic precipitators.

By way of example, increasing the frequency of particle removal by rapping the collection plates has been found to actually increase reentrainment of the particles into the gas stream, which decreases electrostatic precipitator efficiency. Many of the dislodged particles fall into the hopper but some particles are reintroduced into the gas stream. Field studies have shown that as much as 80 percent of the particulate emissions from electrostatic precipitators occurs as a result of particle removal from the collection plates. There have also been occasions where high rapping frequencies distorted the support hangers for the collection plates, especially when coupled with the additional weight caused by accumulations of particles on the collection plates. Distortions in the support hangers produce a misalignment of the collection plates leading to subsequent electrode failure.

One proposed apparatus utilizing the approach of increasing the temperature of the input gas and/or the entire electrostatic precipitator, including the corona electrodes and collection plates, is disclosed by U.S. Pat. No. 4,431,434. Specifically, an electrostatic precipitator is disclosed which has portions of the corona electrodes and collection plates constructed of hollow tubes through which a temperature control fluid is passed to control particle temperature, in an attempt to maintain particle resistivity in a range in which back corona discharge will not be as likely to occur. Such electrostatic precipitators are relatively expensive to construct, requiring tubular configurations, heating units and pumps, and are also expensive to operate. Such an approach to addressing the problem also does not provide a practical means to modify existing electrostatic precipitators to reduce the incidence of back corona discharge.

An electrostatic precipitator incorporating the approach of altering the current density in the collection plates along the entire length of the corona electrode is disclosed in U.S. Pat. No. 4,518,401. In particular, an electrostatic precipitator is described having corona electrodes having a diameter from top to bottom that is approximately three times larger than the diameter of corona electrodes used in typical conventional electrostatic precipitators. This approach substantially reduces efficiencies as a result of the lower rate of particle charging caused by a decreased current density along the entire length of the corona electrode. Further, implementation of this approach for existing electrostatic precipitators may be impractical since all existing corona electrodes would need to be replaced by larger diameter electrodes.

The retrofit approach of converting hot-side electrostatic precipitators to cold-side electrostatic precipitators with the addition of flue gas conditioning, conversion to a cold-side fabric filter baghouse, and enlargement of the existing hot-side electrostatic precipitator, is very expensive. The conversion involves extensive modification to the existing duct work and relocation of the air preheater. It is estimated that such conversions currently cost from about $15 million to $35 million. Worse yet, the conversion does not guarantee that emission limits will be met after the conversion or that the incidence of back corona discharge will be eliminated.

A fundamental problem with each of the foregoing attempts to address the back corona discharge problem in electrostatic precipitators is the focus by industry on altering the structure or operation of the entire electrostatic precipitator instead of focusing on those isolated sections of the electrostatic precipitator in which back corona discharge occurs most frequently.

It is an object of the present invention to reduce the degradation in hot-side, single-stage electrostatic precipitator performance attributed to back corona discharge by developing not only an improved design for hot-side, single-stage electrostatic precipitators but also a practical alternative for modifying existing hot-side, single-stage electrostatic precipitators to substantially reduce back corona discharge.

SUMMARY OF THE INVENTION

The present invention reduces the degradation in hot-side, single-stage electrostatic precipitator performance caused by back corona discharge based upon the discovery that back corona discharge occurs primarily, if not entirely, in restricted, identifiable regions of the collection plates which drop below temperatures at which back corona discharge is initiated. As noted, "back corona discharge" refers to the reverse ionization and/or electrical sparkover that is initiated when the localized electric field produced in the interparticle void spaces in the accumulated particle layer by the ions collecting in the accumulated particle layer exceeds the electrical breakdown strength of the gas contained in the interparticle void spaces. In contrast to back corona discharge, "forward corona discharge (or current)" refers to the flow of negatively charged ions from the corona electrode to the collection plate. Forward corona discharge is initiated when the maximum localized electric field strength adjacent to the corona electrode exceeds a threshold level known as the corona onset localized electric field strength. The magnitude of the forward corona discharge, or electrical current, is directly proportional to the localized electric field adjacent to the corona electrode which is proportional to the steepness, or magnitude, of the gradient in the potential distribution adjacent to the corona electrode.

For purposes of describing this invention, a single stage electrostatic precipitator for removal of particles, such as fly ash or spent catalyst, from a gas stream is considered to be divided into two operating regions which will be designated as the primary and secondary operating regions. The primary operating region encompasses the majority of the particle collection region of the electrostatic precipitator and consists of all areas of the corona electrodes and collection plates where the resistivity of the corresponding accumulated particles is within an acceptable range such that back corona discharge is largely avoided during normal operation. The secondary operating region consists of the areas of the corona electrodes and collection plates where the resistivity of the corresponding accumulated particles is not in an acceptable range with respect to the probable frequency and magnitude of back corona discharge. The differences in the magnitude of the accumulated particle resistivity in the two regions is due to a temperature difference between the two regions. The secondary operating region resides in a lower, cooler part of the electrostatic precipitator which causes the resistivity of the accumulated particles in this region to be higher than that found in the primary region. The primary operating region is directly above the secondary operating region in a warmer part of the electrostatic precipitator.

In light of the above, the present invention substantially reduces the incidence of back corona discharge by providing differing localized electric field strengths at points in primary and secondary operating regions of electrostatic precipitators, which in turn results in differing current densities in corresponding portions of the collection plate. As previously noted, the magnitude of the localized electric field produced in interparticle void spaces by the ions collecting in the accumulated particle layer is directly proportional to the resistivity of the accumulated particles (which is temperature dependent) and the current density in the collection plate. Therefore, by selectively establishing different current densities in those portions of the collection plates positioned within the primary and secondary operating regions, the magnitude of the localized electric field produced in interparticle void spaces by the ions collecting in the accumulated particle layer in the region most susceptible to back corona discharge, i.e., the secondary operating region, can be kept below a level which would result in back corona discharge.

The present invention generally comprises a power supply, at least one corona electrode electrically interconnected to the negative terminal of the power supply and positioned relative to an input gas stream to impart a charge to the particles in the input gas stream, and at least one collection plate electrically connected to the positive terminal of the power supply and positioned within the housing relative to the corona electrode to accumulate the charged particles on the collection plate. The corona electrode and collection plate define an upper laterally extending primary operating region and a lower laterally extending secondary operating region. The primary operating region has a temperature substantially throughout that is greater than a first value and the secondary operating region has a temperature substantially throughout that is less than the first value. The first value is a temperature above which back corona discharge is typically not produced by the accumulated particles. The primary operating region has at least a portion with a localized electric field strength greater than a second value and the secondary operating region has a localized electric field strength substantially throughout that is less than the second value. For many applications, the second value may be at or below a localized electric field strength at or below which there will be no forward corona discharge. The corona electrode and collection plate are enclosed in a housing with an input duct, an output duct, and a hopper device to collect accumulated particles removed from the collection plate.

Typically, a plurality of corona electrodes and collection plates will be alternately disposed in an opposing manner within each of a plurality of lateral sections, or rows, extending across the input gas stream. Preferably, in such arrangements, the secondary operating regions of the sections, or rows, are defined to be progressively larger the further away a section or row is from the input duct. This is due to the realization that, as an input gas stream cools as it moves through the housing, the lower areas of the collection plates most susceptible to back corona discharge will be progressively larger.

In one approach, the first value for a given section, or row, is a predetermined temperature above which the maximum strength of the localized electric field produced in interparticle void spaces by the ions collecting in the accumulated particle layer is less than the minimum electrical breakdown strength of the accumulated particle layer and below which the maximum strength of the localized electric field produced in interparticle void spaces by the ions collecting in the accumulated particle layer is greater than the minimum electrical breakdown strength of the accumulated particle layer for current densities in the collection plate above about 1.0 nA/cm$^2$. In another approach, the first value for a given section, or row, is a predetermined temperature above which substantially all accumulated particles in the primary operating region have a resistivity less than about $1\times10^{11}$ ohm-centimeters, and below which substantially all accumulated particles in the secondary operating region have a resistivity greater than about $1\times10^{11}$ ohm-centimeters.

For many applications, the second value for a given section or row may be substantially equal to the minimum corona onset localized electric field strength of the secondary operating region. Under these circumstances, the primary operating region typically has a current density in the collection plate greater than about 1.0 nA/cm$^2$ and the secondary operating region typically has a current density in the collection plate less than about 1.0 nA/cm$^2$.

In one embodiment, the collection plate terminates at a bottom end of the secondary operating region, and the corona electrode consists of a first electrode portion positioned entirely within the primary operating region and having an outer surface configuration which generates a maximum localized electric field strength along the first electrode portion that is greater than the second value, and a second electrode portion positioned entirely within the secondary operating region and having an outer surface configuration which generates a maximum localized electric field strength along the second electrode portion that is less than the second value. As should be appreciated, the maximum localized electric field strengths in the primary and secondary operating regions will be located immediately adjacent to the outside surface of the corona electrode, with localized electric field strengths decreasing between the electrode and collection plate. Typically, a plurality of alternately and oppositely disposed corona electrodes and collection plates will be positioned in each of a plurality of sections, or rows, with each section, or row, having a dedicated transformer-rectifier. Preferably, in such arrangements, the lengths of the first and second electrode portions of the corona electrodes in the sections, or rows, will progressively decrease and increase, respectively, the further a given section, or row, is from the input duct. That is, the first and second electrode portions in the first section, or row, nearest the input duct will be larger and smaller, respectively, than the first and second electrode portions in the adjacent, second section, or row, and so on.

In a first corona electrode configuration, the outer surface configuration of the first electrode portion is substantially cylindrical and has a first radius and the outer surface configuration of the second electrode portion is substantially cylindrical and has a second radius greater than the first radius. Consequently, the maximum localized electric field strength in the primary operating region will be located at a first radial distance from the electrode center axis, and the maximum localized electric field strength in the secondary operating region will be located at a second radial distance from the center axis, the second radial distance being greater than the first radial distance. The utilization of cylindrical surface configurations simplifies design, construction and/or existing unit retrofit considerations.

As will be appreciated, numerous other outer surface configurations can also be employed in the present invention to yield the desired field strength characteristics. For example, the first electrode portion may include at least one spike, or like feature, to increase the maximum localized electric field strength adjacent to the spike. The employment of spikes or other like configurations in the first electrode portion will hasten the onset of the forward corona current, as desirable.

In another corona electrode configuration, the corona electrode is of a rigid frame type in which the first electrode portion has at least one substantially cylindrical charging section having a third radius and the second electrode portion has at least one substantially cylindrical charging section having a fourth radius, with the third radius less than the fourth radius.

In a second embodiment of the present invention, the bottom end of the collection plate defines the lower end of the secondary operating region, and the bottom end of the corona electrode defines the lower end of the primary operating region. That is, by having one or more electrodes in each of one or more sections terminate at a higher, selected location than the corresponding opposing collection plates, the localized electric field strengths substantially throughout the lower regions most susceptible to back corona discharge are maintained below corresponding second values, as defined above.

The size of the primary operating region can be increased and the size of the secondary operating region may be reduced by using insulation and/or a heating assembly to maintain a greater portion of the electrostatic precipitator above the first value discussed above. The insulation and/or heating assembly would be typically mounted on the exterior of the walls of the hopper or on a portion of the collection plate.

BRIEF DESCRIPTION OF THE DRAWINGS

FIG. 8 is a graph showing the relationship between particle temperature and particle resistivity for an embodiment of the present invention operating on a fluid catalytic cracking unit at the Tosco Avon Refinery;

FIG. 9 is a graph showing the relationship between current density and average field strength at 500° F. and 13% moisture in a simulation test of a embodiment of the present invention operating on a fluid catalytic cracking unit at the Tosco Avon Refinery.

DETAILED DESCRIPTION OF THE PREFERRED EMBODIMENT

The present invention reduces the degradation in hot-side, single-stage electrostatic precipitator performance caused by back corona discharge based upon the recognition that back corona discharge occurs primarily, if not entirely, in restricted, identifiable regions of the collection plates that drop below temperatures at which back corona discharge is initiated.

Figure 1:
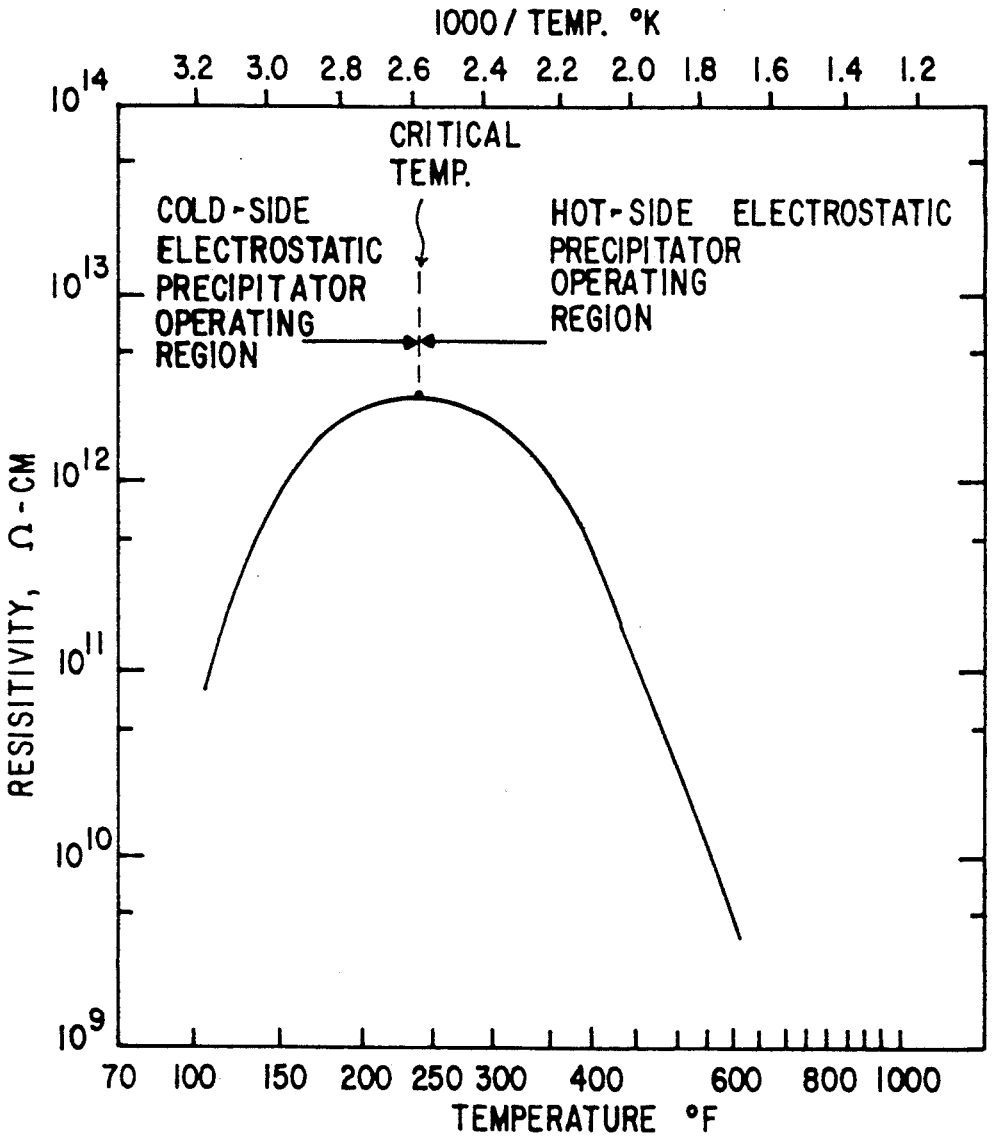
FIG. 1 is a graph showing the relationship between particle temperature and particle resistivity for typical fly ash particles.
Figure 2:
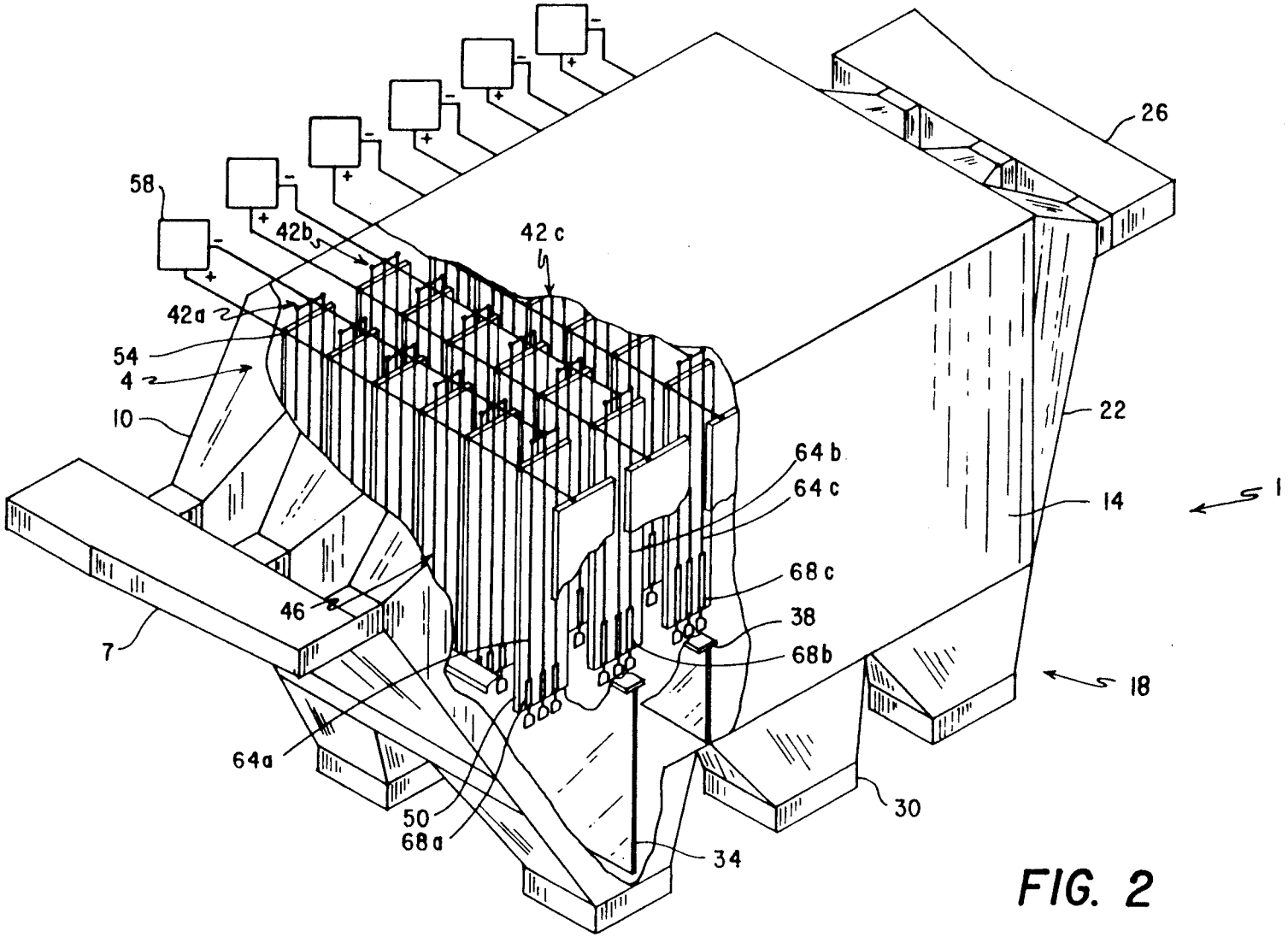
FIG. 2 is a perspective view of a first embodiment of the present invention.
Figure 3:
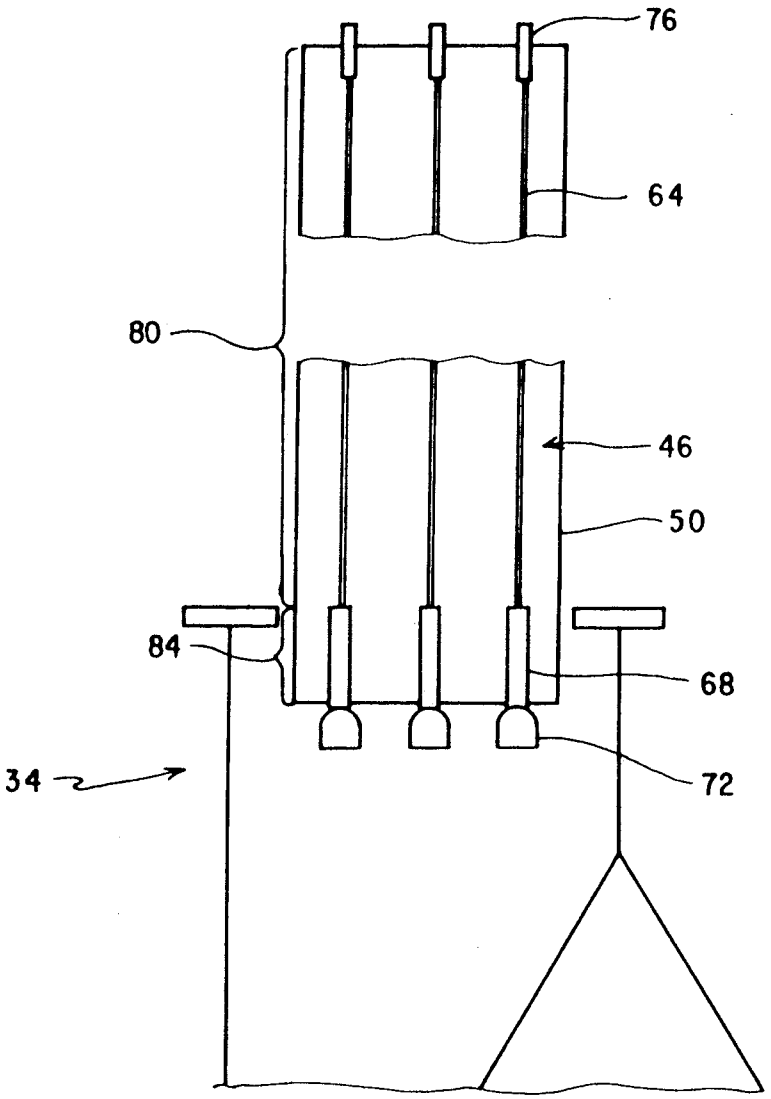
FIG. 3 is an enlarged side view of a top and base of one collection plate and corresponding weighted wire corona electrode assembly within a section, or row, of the first embodiment of the present invention.
Figure 4:
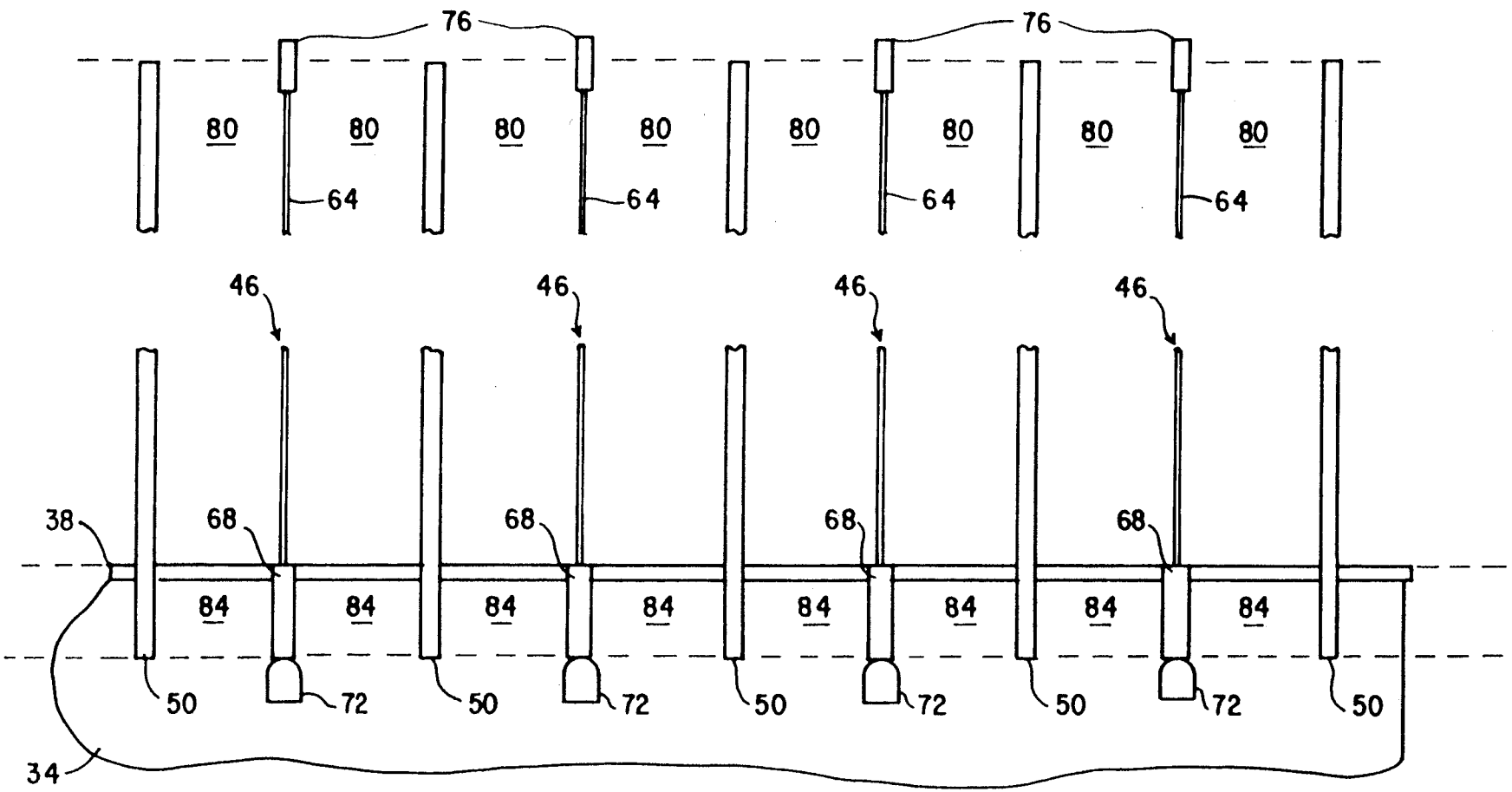
FIG. 4 is an enlarged end view of the collection plates and weighted wire corona electrode assemblies in a single section of the first embodiment of the present invention.

Referring to FIGS. 2–4, a first embodiment of a hot-side, single-stage electrostatic precipitator apparatus for removal of particles such as fly ash and spent catalyst from a gas stream embodies the present invention consists of a housing assembly 1 and an electrostatic precipitating assembly 4. The housing assembly 1 comprises an input duct 7, one or more input plenums 10, electrostatic precipitator shell 14, one or more hopper assemblies 18, one or more output plenums 22, and output duct 26. Each hopper assembly 18 consists of hopper cones 30 for continuous or periodic disposal of particles, sneak-by baffles 34 to reduce the likelihood that particle-laden gas will "sneak" under, or bypass, the electrostatic precipitating assembly 4, and catwalks 38 mounted on top of the sneak-by baffles 34 for servicing of the electrostatic precipitating assembly 4. Sneak-by baffles may also be mounted on the electrostatic precipitator shell 14 adjacent to and above the electrostatic precipitating assembly 4 to further reduce the likelihood that particle-laden gases will travel around or over the electrostatic precipitating assembly 4.

The electrostatic precipitating assembly 4 comprises a plurality of sections 42. Each section 42 includes a plurality of weighted wire corona electrode assemblies 46, a plurality of collection plates 50, and a plurality of electrical conductors 54 to connect the weighted wire corona electrode assemblies 46 and collection plates 50 within a given section 42 to the negative and positive terminals, respectively, of a power supply/transformer-rectifier 58. Each weighted wire corona electrode assembly 46 consists of a neck 76, substantially cylindrical first electrode portion 64 and second electrode portion 68, and bottle weight 72. The weighted wire corona electrode assembly 46 and collection plate 50 comprise an electrically conductive metal, typically steel alloys.

A first electrode portion 64 and second electrode portion 68 of each weighted wire corona electrode assembly 46 and adjacent collection plates 50 together form an upper laterally extending primary operating region 80 and lower laterally extending secondary operating region 84. The primary and secondary operating regions 80, 84 are defined based upon the above-noted recognition that back corona discharge is more likely to occur in the lower regions of collection plates 50. By controlling the current density in the secondary operating region 84 of the collection plate 50, the second electrode portion 68 substantially reduces the incidence of back corona discharge. The underlying theory utilized to define primary and secondary operating regions 80 and 84 will now be explained in greater detail.

As discussed, back corona discharge is produced when the strength of the localized electric field produced in interparticle void spaces by the ions collecting in the particle layer accumulated on a collection plate 50 exceeds the electrical breakdown strength of the accumulated particle layer. Further, it is again pointed out that the thickness of an accumulated layer of particles is believed to be largely unrelated to the onset of back corona discharge. Rather, the strength of the localized electric field generated in interparticle void spaces by a layer of particles is believed to be largely related to the resistivity of particles accumulated on the collection plate 50 and the current density within the corresponding area of the collection plate 50, as shown by the following equation:

$$E_d = 4\ R_{ho} j$$

where $E_d$ is the localized electric field strength produced in interparticle void spaces by the ions collecting in the accumulated particle layer $R_{ho}$ is the particle resistivity, and j the current density within the corresponding area of the collection plate 50. Thus, the localized electric field strength produced in interparticle void spaces by the ions collecting in the accumulated particle layer, and therefore the likelihood of back corona discharge increases the higher the particle resistivity and/or the higher the current density in the corresponding area of the collection plate. Relatedly, and as noted, particle resistivity in hot-side electrostatic precipitators is inversely proportional to particle temperature (i.e., as temperature decreases, resistivity increases proportionally). Therefore, it should be appreciated that the onset of back corona discharge can be substantially reduced, or eliminated, by selectively reducing the magnitude of the current density in the cooler, lower area of a collection plate 50 most susceptible to back corona discharge.

In normal operation, a temperature gradient exists along the vertical length of the collection plate 50, which produces a similar gradient in the resistivity in the accumulated particles on the collection plate 50. This is so because heat from the gas stream passing through gas housing assembly 1 is lost via radiation to the walls of the hopper assembly 18 and electrostatic precipitating shell 14. Also, obstructions such as the sneak-by baffles 34 and the settling of cooled gas in the hopper cones 30 reduce gas convection resulting in cooling of the gas stream, further contributing to the temperature gradient. An additional temperature drop will occur across the horizontal length of the electrostatic precipitating assembly 4 with the downstream sections 42 of electrostatic precipitating assembly 4 operating at progressively lower temperatures. The coolest region within the electrostatic precipitator assembly 4 is thus found at the bottom of the final section 42 of the electrostatic precipitating assembly 4 adjacent to output duct 26, causing that section to have the highest resistivities in the accumulated particles and the most rapid deterioration in electrical conditions due to back corona discharge.

In view of the foregoing, it should be apparent that controlling the current density in the lower regions of the collection plate 50 having the highest particle resistivities reduces the magnitude of the localized electric field produced in interparticle void spaces by the ions collecting in the accumulated particle layer, and therefore the incidence of back corona discharge. Therefore, the first embodiment of the present invention substantially reduces the incidence of back corona discharge by using a first electrode portion 64 and collection plate 50 to define a primary operating region 80 and a second electrode portion 68 and collection plate 50 to define a secondary operating region 84, wherein for example the current density in the primary operating region 80 of the collection plate 50 is greater than about 1.0 nA/cm$^2$ and in the secondary operating region 84 of the collection plate 50 is less than about 1.0 nA/cm$^2$. To accomplish this result, while maintaining efficiency, first and second electrode portions 64, 68 are designed so that at least a portion of the primary operating region 80 has a localized electric field strength greater than the maximum localized electric field strength generated substantially throughout the secondary operating region 84. Preferably for many applications, the maximum localized electric field strength substantially throughout the secondary operating region 84 is less than the minimum corona onset localized electric field strength for the secondary operating region 84.

A current density of less than about 1.0 nA/cm$^2$ in the secondary operating region 84 is generally insufficient to cause the onset of back corona discharge in the secondary operating region 84. By way of example, in a utility application having an input gas stream having a temperature of about 500° F. to about 800° F., the electrical breakdown strength of the accumulated particle layer will typically range from about 10 kv/cm to about 20 kv/cm. Using the above equation, for a current density of 1.0 nA/cm$^2$ and electrical breakdown strength of 10 kv/cm, the particle resistivity at which back corona discharge may occur is about $1\times10^{13}$ ohm-centimeters. In such applications, this resistivity exceeds the maximum resistivity of the particles at the critical temperature.

As noted above, the downstream sections 42 of the electrostatic precipitator assembly 4 operate at progressively lower temperatures. Accordingly, the length of the first electrode portion 64 will be progressively shorter and the length of the second electrode portion 68 progressively longer for successive downstream sections 42 so as to define progressively smaller and larger, respectively, primary and secondary operating regions. For example, as shown in FIG. 2, first electrode portion 64*a* in the first section 42*a* will be longer than the first electrode portion 64*b* in the second section 42*b*, and first electrode portion 64*b* in the second section 42*b* will be longer than the first electrode portion 64*c* in the third section 42*c*. Conversely, second electrode portion 68*a* in the first section 42*a* will be shorter than the second electrode portion 68*b* in the second section 42*b*, and second electrode portion 68*b* in the second section 42*b* will be shorter than the second electrode portion 68*c* in the third section 42*c*.

For each section 42, the length of the first electrode portion 64 is defined so that the primary operating region 80 has a temperature substantially throughout that is greater than a predetermined value, and the length of the second electrode portion 68 is defined so that the secondary operating region 84 has a temperature substantially throughout that is less than the predetermined temperature. There are at least two methods to determine the predetermined temperature for a given section 42.

In a first approach, the predetermined temperature represents the location in the temperature gradient along the vertical length of the collection plate 50 above which the maximum strength of the localized electric field produced in interparticle void spaces by the ions collecting in the accumulated particle layer is less than the minimum electrical breakdown strength of the accumulated particle layer and below which the maximum strength of the localized electric field produced in interparticle void spaces by the ions collecting in the accumulated particle layer is greater than the minimum electrical breakdown strength of the accumulated particle layer for current densities in the collection plate 50 above about 1.0 nA/cm$^2$.

The predetermined minimum temperature can be determined, for example, by simulating the electrical operating characteristics of each section 42 of the electrostatic precipitating assembly 4 in the laboratory at different temperatures using a representative sample of the particles typically treated by the electrostatic precipitating assembly 4. The sample should be representative not only of particle composition but also particle size and shape. A possible procedure and apparatus to use in performing the simulation tests in the laboratory are discussed below in the example. In most applications, the particle composition and size distribution will remain relatively constant over time provided that the general composition of the uncombusted particulate source material, which is coal for utility applications and catalysts for petroleum refinery and chemical plant applications, remains substantially constant. The predetermined temperature for a given section 42 is that temperature at which no back corona discharge is encountered in the simulation tests at the typical operating voltages and currents for the electrostatic precipitating assembly 4.

In a second approach, the relative lengths of the primary operating region 80 and secondary operating region 84 of the weighted wire corona electrode assembly 46 and collection plate 50 are alternatively determined based upon the relationship between temperature and the average resistivity of the particles. Above the predetermined temperature, substantially all of the particles accumulated in the primary operating region 80 of the collection plate 50 have a resistivity less than about $1\times10^{11}$ ohm-centimeters. Below the predetermined temperature, substantially all of the particles accumulated in the secondary operating region 84 of the collection plate 50 have a resistivity greater than about $1\times10^{11}$ ohm-centimeters. The preferred range of particle resistivities in most electrostatic precipitator applications is from about $5\times10^{9}$ to $1\times10^{11}$ ohm-centimeters. If the resistivity is above about $1\times10^{11}$ ohm-centimeters, the ions collecting in the accumulated particle layer will at normal current levels typically produce a localized electric field strength in interparticle void spaces exceeding the electrical breakdown strength of the accumulated particle layer. If the resistivity is below about $5\times10^{9}$ ohm-centimeters, the force holding the particles onto the collection plates 50 is reduced and the particles are easily reentrained.

There are several methods to measure or predict particle resistivity. The resistivity of a representative sample of particles may be measured in-situ in the field or in the laboratory under simulated conditions. In-situ measurements are made using a point-plane resistivity device. The point-plane resistivity device measures resistivity by (i) applying a high voltage to the point electrode to precipitate a sample of particles onto a collector disc and (ii) when an adequate sample is collected, measuring both the leakage current through the accumulated particle layer with an electrometer and the accumulated particle layer thickness with a micrometer. The particle resistivity is then calculated using the ratio of the average electric field strength to the current density in the collection disc prior to sparkover. This procedure is further described in *ASME Power Test Code Number* 28 (1965).

The resistivity of particles may also be measured in a laboratory using the setup and procedure defined by the *IEEE Standard* 548-1981 *Guidelines for the Laboratory Measurement and Reporting of Fly Ash Resistivity* (1981). By way of example, for typical utility applications, fly ash resistivity is measured in the disclosed procedure as a function of temperature and pressure by (i) placing a representative particle sample into a guarded electrode cell, (ii) heating the sample in the presence of dry air, (iii) maintaining the sample at a temperature of 460° C. for sixteen hours, (iv) after sixteen hours, humidifying the gas and allowing the cell to cool by convection, and (v) measuring the particle resistivity at an average electric field strength of 4 kv/cm as the system cools.

Additionally, there are several methods for predicting the resistivity of fly ash based upon the chemical composition of the coal and fly ash. For example, Bickelhaupt, *A Technique for Predicting Fly Ash Resistivity*, EPA-600/7-79-204, Industrial Environmental Research Laboratory, Research Triangle Park, N.C. (August 1979) describes a computer model to predict fly ash resistivity as a function of temperature, water vapor, and sulfur trioxide concentration.

The use of simulation tests at typical operating voltages and currents for the electrostatic precipitating assembly 4 is the preferred method to arrive at the predetermined temperature. Simulation tests consider not only the effect of particle resistivity but also particle size and shape, particle packing density in the accumulated particle layer, and gas composition and density, which all impact the electrical breakdown strength of the accumulated particle layer. Like particle resistivity, gas density is also dependent upon temperature. Basing the location of the junction between the primary and secondary operating regions 80, 84 solely upon particle resistivity ignores the impact of the latter variables on the electrical breakdown strength of the particle layer.

Under either approach, for each section 42 the position of the predetermined temperature on the collection plate 50 and therefore the junction between the primary operating region 80 and secondary operating region 84 will depend upon the design and configuration of the electrostatic precipitating apparatus 4, including the position of the sneak-by baffles 34. In most applications, the junction will be located near the top of the sneak-by baffle 34. As discussed above, the junction will typically be positioned progressively higher relative to the collection plates 50 in each successive downstream section 42 as a result of the cumulative effect of gas cooling within the preceding sections 42.

Returning to the embodiment of the present invention in FIGS. 2, 3, and 4, the first electrode portion 64 defines and is thereby positioned entirely within the primary operating region 80, and the second electrode portion 68 defines and is thereby positioned entirely within the primary operating region 84. The first and second electrode portions 64, 68 have outer surface configurations such that the maximum localized electric field strengths along the portion of the first electrode portion 64 facing the collection plate 50 are greater than the maximum localized electric field strengths along the portion of the second electrode portion 68 facing the collection plate 50. For weighted wire corona electrode assemblies 46, this result is accomplished by outer surface configurations for the first and second electrode 64, 68 that are substantially cylindrical such that the first electrode portion 64 has a radius smaller than the radius of the substantially cylindrical second electrode portion 68. By virtue of the larger radius, the second electrode portion 68 maintains, for example, the current density in the secondary operating region 84 less than about 1.0 $nA/cm^2$.

The radii of the first and second electrode portions 64, 68 will depend upon a number of factors including the temperature and pressure of the gas between the weighted wire corona electrode assembly 46 and collection plate 50. By way of example, in a utility application, the diameter of the first electrode portion 64 is typically about 1/10 inch to produce a current density in the primary operating region 80 of the collection plate 50 of greater than about 1.0 $nA/cm^2$ at normal operating voltages, and the diameter of the second electrode portion 68 may range from about ½ to ⅝ inches to produce a current density in the secondary operating region 84 of the collection plate 50 of less than about 1.0 $nA/cm^2$ at normal operating voltages. These diameters include the contribution of any material, whether acting as a conductor or insulator, that effectively increases the diameter of the weighted wire corona electrode assembly 46.

For the substantially cylindrical first electrode portion 64 the maximum localized electric field strength is at a first radial distance from an axis coinciding with the first electrode portion 64 and for the substantially cylindrical second electrode portion 68 the maximum localized electric field strength is at a second radial distance from an axis coinciding with the second electrode portion 68 with the second radial distance greater than the first radial distance. The maximum localized electric field strength is typically located at the outer surface of the weighted wire corona electrode assembly 46. Accordingly, for weighted wire corona electrode assemblies 46, the first radial distance will coincide with the radius of the first electrode portion 64 and the second radial distance with the radius of the second electrode portion 68. The first electrode portion 64 produces a higher maximum localized electric field strength at substantially all points adjacent the first electrode portion than the second electrode portion 68 at substantially all points adjacent the second electrode portion and has a lower corona onset voltage. Corona onset voltage is the minimum voltage above which there is measurable forward corona discharge from the corona electrode to the collection plate.

The magnitude of the maximum localized electric field strength at a given point in an electrostatic precipitator is a function of a number of factors including the voltage, temperature and pressure of the gas surrounding the corona electrode assembly, the distance between the weighted wire corona electrode assembly 46 and adjacent collection plate 50, and the outer surface configuration of the weighted wire corona electrode assembly 46. Concerning the last factor, the maximum localized electric field strength produced at points adjacent the wire for smooth, cylindrical wires increases with decreasing wire diameter; however, the localized electric field strength decreases more rapidly for smaller diameter wires than larger diameter wires with increasing distance from the wire. Sharp ridges or points on the surface of the corona electrode assembly further increase the maximum localized electric field strength adjacent the sharp ridge or point produced by the corona electrode assembly by increasing the steepness of the gradient in the potential distribution adjacent to the sharp ridge or point on weighted wire corona electrode assembly 46.

The first and second electrode portions 64, 68 may be either solid or hollow as the maximum localized electric field strength at a given point for cylindrical weighted wire corona electrode assemblies 46 is related to the radius of curvature of the corona electrode assembly and not its volume or density. The second electrode portion 68 may be formed by placing a hollow pipe or other suitable cylindrical device of the appropriate diameter and length over a conventional weighted wire corona electrode assembly. Custom-made weighted wire corona electrode assemblies 46 may also be utilized. The bottle weight 72 maintains tension in the weighted wire corona electrode assembly 46 to prevent the weighted wire corona electrode assembly 46 from bowing during operation.

Figure 5:
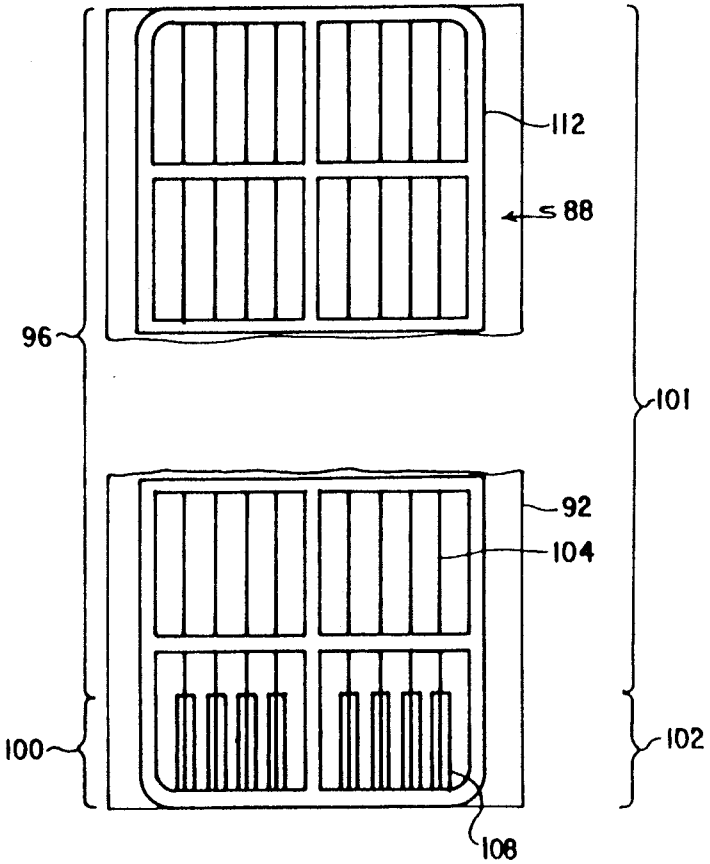
FIG. 5 is an enlarged side view of a top and base of a collection plate and a rigid frame type corona electrode assembly of a bedspring configuration.

In addition to the weighted wire corona electrode assemblies 46, an electrostatic precipitating apparatus 1 may employ rigid frame-type corona electrode assemblies, such as assemblies of the bedspring or strung mast configuration, or spiked corona electrode assemblies, such as the DURA-TRODE ® assembly. Referring to FIG. 5, a rigid frame-type corona electrode assembly 88 of the bedspring-type and collection plate 92 can be utilized to define primary operating region 96 and secondary operating region 100. Rigid frame corona electrode assembly 88 consists of a plurality of substantially cylindrical first charging sections 104 and second charging sections 108 tensioned by a structural framework 112. First charging sections 104 are found in the first electrode portion 101 and second charging sections 108 in second electrode portion 102.

Figure 6:
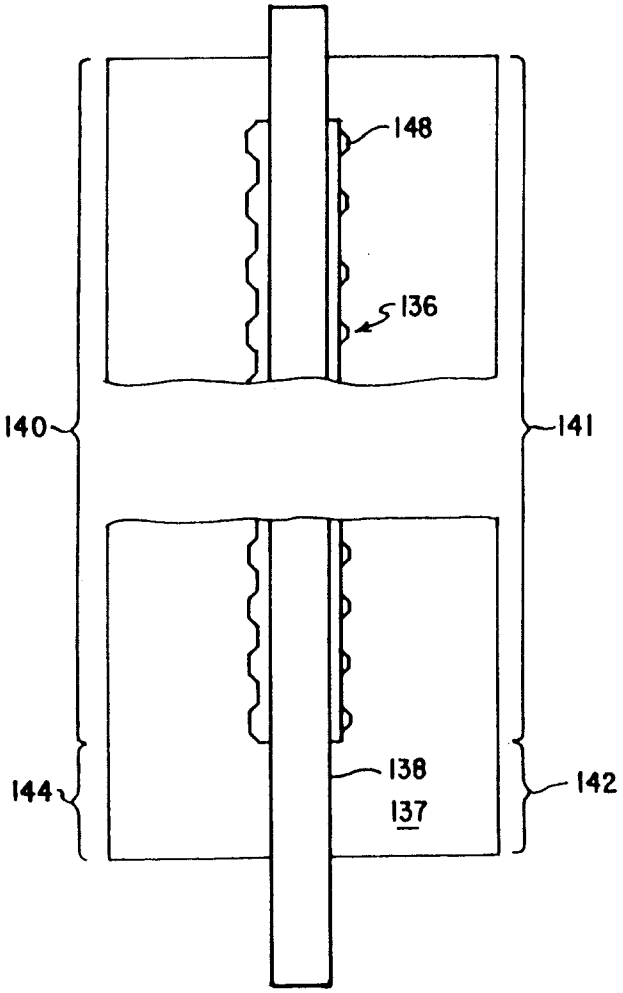
FIG. 6 is an enlarged side view of a top and base of a collection plate and a spiked corona electrode assembly according to the first embodiment of the present invention.

Referring to the FIG. 6, a spiked corona electrode assembly 136 and collection plate 137 can be utilized to define primary operating region 140 and secondary operating region 144 Spiked corona electrode assembly 136 consists of center electrode section 138 and spikes 148. Compared to weighted wire and rigid frame corona electrode assemblies which typically comprise cylindrical members, spiked corona electrode assemblies 136 typically may have a wide variety of configurations, including cylindrical, triangular, elliptical, square and rectangular and generally have larger cross-sectional areas. The first electrode portion 141 has spikes 148 to increase the maximum localized electric field strength adjacent to the spike 148 by increasing the steepness of the gradient in the potential distribution adjacent to the spike 148. The spikes 148 therefore cause a lower corona onset voltage and higher current densities than the rigid corona electrode assembly 136 would experience without the spikes. Such spikes 148 may also be used on weighted wire corona electrode assemblies and rigid frame-type corona electrode assemblies.

As should be apparent, the second electrode portion 142 may be formed by a number of different methods. By way of example, the spikes 148 may be removed from the secondary operating region 144 of a spiked corona electrode assembly. This approach, however, may not yield the desired electrical operating characteristics for the secondary operating region 144 as the surface of the center electrode section 138 may have angles or curved surfaces or be at a distance from the collection plate 137 sufficient to produce a maximum localized electric field strength adjacent the corona electrode assembly in excess of the desired level. It is possible, though often not practical, to grind down the center electrode section 138, including such angles or curved surfaces, to produce the desired maximum localized electric field strengths in the secondary operating region 144. The second electrode portion 142 also may be designed to be substantially cylindrical in accordance with the methodologies and specifications discussed above for weighted wire corona electrode assemblies.

Figure 7:
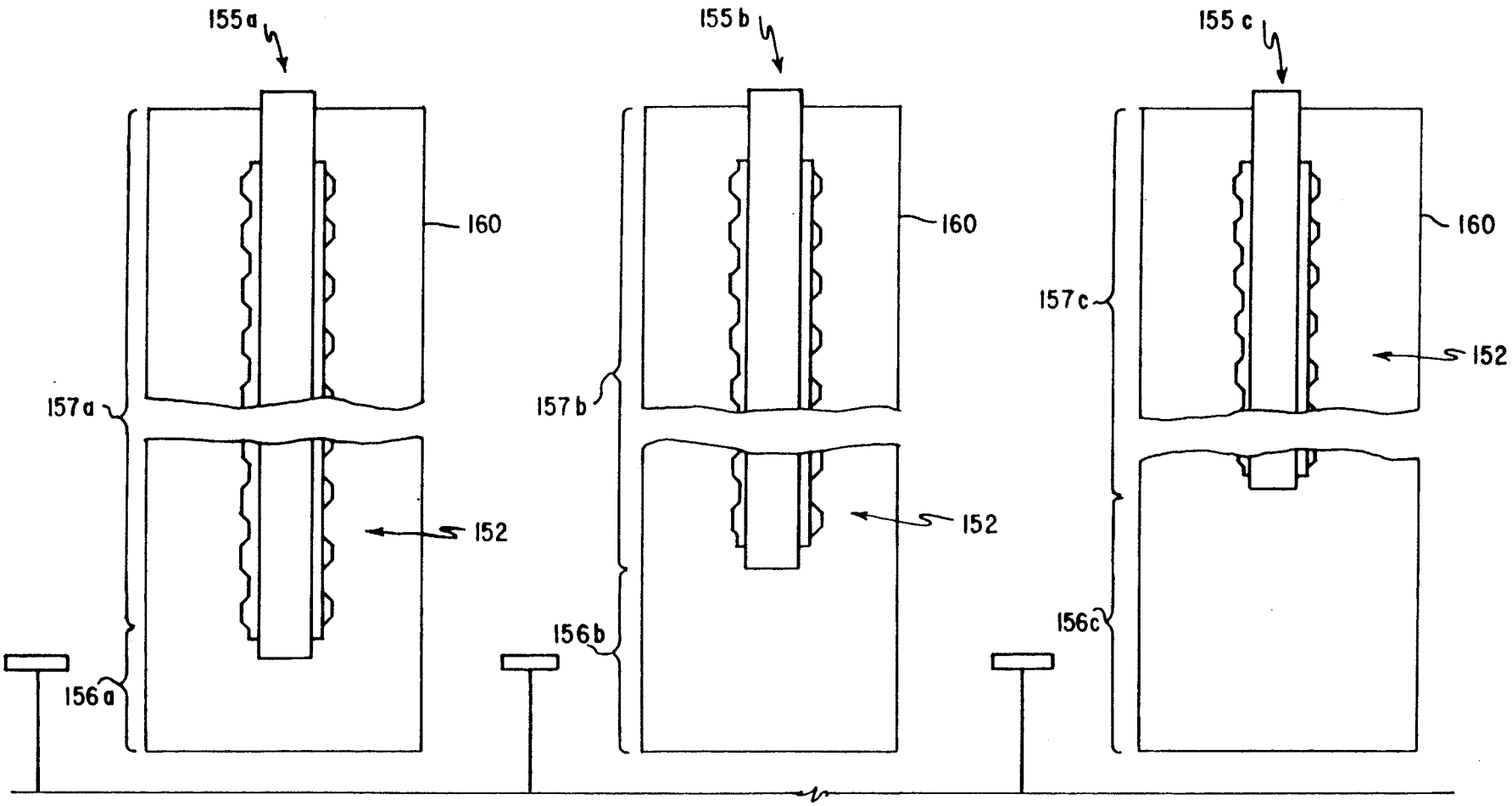
FIG. 7 is an enlarged side view of a top and base of a collection plate and spiked corona electrode assembly of a second embodiment of the present invention.

Referring to FIG. 7, a second embodiment of the present invention is illustrated wherein an electrostatic precipitating assembly 4 has a collection plate 160 having a bottom end defining the lower edge of a secondary operating region 156, and a spiked corona electrode assembly 152 positioned adjacent to the primary operating region 157 and terminating at the bottom end of the primary operating region 157. In this embodiment, no corona electrode extends into the secondary operating region 156. As will be appreciated, the second embodiment is particularly apt for the modification of existing units since such modification only entails the determination of where the primary and secondary operating regions 157, 156 should be defined, and cutting off the corona electrode assemblies 152 accordingly.

As noted above, the downstream sections 155 operate at progressively lower temperatures. Accordingly, the length of the primary operating region 157 will be progressively shorter and the length of the secondary operating region 156 will be progressively longer for successive downstream sections 155. For example, as shown FIG. 7, the primary operating region **157*a* in the first section 155*a* will be longer than the primary operating region 157*b* in the second section 155*b*, and the primary operating region 157*b* in the second section 155*b* will be longer than the primary operating region 157*c* in the third section 155*c*. Conversely, secondary operating region 156*a* in the first section 155*a* will be shorter than the secondary operating region 156*b* in the second section 155*b* and secondary operating region 156*b* in the second section 155*b* will be shorter than the secondary operating region 156*c* in the third section 155*c***.

In a further extension of the present invention, the size of the secondary operating region in a given application may be reduced by heating and/or insulating all or part of the electrostatic precipitator shell and/or hopper cones, or heating the lower sections of the collection plates. To reduce the degree of cooling of the accumulated particle layer, depending upon the climate in which the electrostatic precipitator apparatus is located, a heating assembly and/or insulation may be mounted or part or all of the interior or exterior of a electrostatic precipitator shell and hopper cones or a heating assembly may be mounted on the lower sections of the collection plates. The heating assembly may supply heat by means of bleed gas, electricity, or any other energy source. The heating assembly may have tubular construction or be strip or blanket type heaters.

With reference again to FIGS. 2–4, an input gas stream containing particles enters the housing assembly 1 by way of the input duct 7 and input plenums 10. The input plenums 10 reduce turbulence in the input gas stream caused by a sudden increase in the cross-sectional area of flow. As the input plenums 10 gradually increase the cross-sectional area of flow, the velocity of the input gas stream decreases and large particles drop out of the input gas stream into the hopper cones 30. Each transformer-rectifier 58 is controlled to maintain optimal voltage levels.

The particles entering the electrostatic precipitating assembly 4 are primarily charged by the primary operating region 80 of the weighted wire corona electrode assemblies 46. The charged particles then accumulate on positively charged collection plates 50 in both the primary collection and secondary operating regions 80, 84.

In many applications of the invention to existing units, the input plenums 10 may cause the input gas stream to contact the entire length of the collection plates 5 in the first section 42 and heat the collection plates 50 in the first section 42 sufficiently to avoid back corona discharge. However, downstream sections 42 will generally require modification as set forth herein to counter back corona discharge.

After accumulation on the collection plates 50, the particles are continuously or periodically removed from the collection plates 50, causing the accumulated particles to drop into the hopper cones 30 located below the collection plates 50. This particle removal process is known as rapping. Rapping is typically accomplished by mechanically jarring the collection plates to dislodge the particles by means such as electric vibrators, pneumatic vibrators, solenoid coil impact rappers and mechanical tumbling hammers.

An output gas stream cleaned by the electrostatic precipitator assembly 4 flows outward through the output plenums 22 which gradually decrease the cross-sectional area of flow and increase the output gas stream velocity. After passing the output plenums 22, the output gas stream enters the output duct 26 for further processing or discharge.

In light of the preceding discussion, a number of advantages of the present invention are apparent. First, the present invention more efficiently removes particles such as fly ash from particle-laden gases by substantially decreasing the occurrence of back corona discharge. The increased efficiency over prior art precipitators causes reduced particulate emissions into the atmosphere. Second, the present invention allows for relatively inexpensive modification of existing electrostatic precipitators. Third, such modifications may be made with little or no increase in operating costs. Fourth, the present invention does not require modification of an entire electrostatic precipitator but only those isolated sections in which back corona discharge occurs most frequently.

The following example is provided for purposes of illustration and is not intended to limit the scope of the invention.

EXAMPLE

An electrostatic precipitator operating on a fluid catalytic cracking unit (FCCU) at the Tosco Avon Refinery located in Martinez, Calif., was modified according to the present invention. The fluid catalytic cracking unit employs two identical Research Cottrell electrostatic precipitators (ESP), labeled East and West. Each electrostatic precipitator collects particles produced by decomposition of catalysts consisting primarily of aluminum-silicates with a resistivity of about $1\times10^{10}$ ohm-centimeters at an operating temperature of 550° F.

Details of the East and West electrostatic precipitators are presented in Table 1. As shown in Table 1, each electrostatic precipitator consists of seven sections. Each section is energized by a single transformer-rectifier. The fifth and sixth sections, though comprising one mechanical unit, are split into two separate sections each powered by separate transformer-rectifier sets.

TABLE 1

| Summary of Design Data on the FCCU ESP | |
|---|---|
| Manufacturer | Research Cottrell |
| Housing | Two ESP Boxes |
| Mechanical Units | 6 per Box |
| Sections | 7 per Box |
| Gas Flow Passages | 56 per Box |
| Collection Plates | |
| Plate Spacing | 10 inches |
| Plate Height | 30 feet |
| Total Plate Length | 51 feet |
| Length of Sections | 9 feet for 1-5, 6 ft for 6 |
| Total Plate Area | 171,360 sq. feet per box |
| Total Cross Section Area | 1,400 sq. feet |
| Gas Conditions | |

TABLE 1-continued

| Summary of Design Data on the FCCU ESP | |
|---|---|
| Gas Flow at Full Load | 600,000 acfm |
| Gas Velocity at Full Load | 3.6 ft/s |
| Residence Time at Full Load | 14.3 s |
| Corona Electrodes | |
| Design | Weighted Wire |
| Spacing | 9 inches |
| Number | 3308 per box |
| Total Wire Length | 114,239 |

Prior to modification, the East and West electrostatic precipitators experienced time-dependent degradation of their electrical operating characteristics. Table 2 shows the operating voltages and currents for the East electrostatic precipitator immediately before cleaning the electrostatic precipitator, immediately after cleaning, and about six weeks after cleaning. Before cleaning, the last five sections were operating at voltages from 21 to 25 kilovolts. Immediately after cleaning, the voltages increased to 29 to 35 kilovolts. However, six weeks later, the operating voltages were below 20 kilovolts. The opacity readings, which are provided in the table, show that the improved electrical conditions obtained after cleaning resulted in a lower opacity.

TABLE 2

Electrical Operating Condition for the East Electrostatic Precipitator Before and After Cleaning.

| Electrical Section | Before Cleaning kV | Before Cleaning na/cm² | After Cleaning kV | After Cleaning na/cm² | Six Weeks After Cleaning kV | Six Weeks After Cleaning na/cm² |
|---|---|---|---|---|---|---|
| 1 (Inlet) | 34 | 19 | 34 | 20 | 30 | 20 |
| 2 | 28 | 20 | 29 | 17 | 28 | 19 |
| 3 | 23 | 35 | 29 | 36 | 20 | 35 |
| 4 | 25 | 36 | 29 | 43 | 19 | 38 |
| 5 | 21 | 80 | 30 | 86 | 18 | 79 |
| 6 | 24 | 86 | 35 | 79 | 18 | 86 |
| 7 | 22 | 67 | 35 | 69 | 19 | 65 |
| Opacity | 7.0 | | 1.8 | | 5.0 | |

As shown in Table 2, the degradation occurred in sections 3 through 7 of the electrostatic precipitator while sections 1 and 2 showed little deterioration. As the operating voltages dropped in sections 3 through 7, the current levels remained at or near the limits of the power supply. This is characteristic of back corona discharge. Having determined that sections 3 through 7 of the electrostatic precipitator were experiencing degradation in operating characteristics as a result of back corona discharge, the resistivity characteristics of the particles were analyzed as a function of temperature using a computer automated system which reproduced the desired range of gas temperatures, moisture contents, and average electric field strengths. The computer controlled system was programmed to run the IEEE Standard 548-1984 time/temperature routine. The resistivity of the particles was measured at several points while the temperature was ascending and then at several points while the temperature was descending. The moisture content was controlled by passing air through a bubbler and then exposing the particle samples to the humidified gas during the particle resistivity measurements. The results of the laboratory resistivity measurements on an particle sample collected from section 6 of the electrostatic precipitator are shown in FIG. 8.

A sample of collection plate material was cut from the last transformer-rectifier section of the electrostatic precipitator to evaluate the characteristics of the accumulated particle layer on the surface of the collection plate. The apparatus used to simulate gas conditions in the electrostatic precipitator employed a point-plane precipitator in a leak tight chamber housing a needle corona discharge electrode and a disk collection plate. The temperature of the gas was controlled by temperature controllers connected to a sensing probe and a gas heater. The moisture content of the gas was controlled by passing heated air through a bubbler located upstream of the precipitator in a temperature controlled water bath. Although not done in the experiment, it is also possible to attain greater accuracy in such a simulator by using a gas having a chemical composition similar to the actual input gas stream into the electrostatic precipitator. In most applications, the chemical composition of the input gas stream will be relatively constant over time.

Using the above apparatus, a representative particle sample was deposited on the disk collection plate, and voltage-current characteristics were measured at temperatures of 500° F., 450° F., 400° F., and 350° F., with a moisture concentration of 13%. FIG. 9 shows the electrical characteristics measured at 500° F. The solid line represents the increasing voltage and the dashed line represents decreasing voltage. The corona onset occurred at an average electric field strength of approximately 2.5 kilovolts per centimeter and began to rise sharply. "Average field strength" refers to the ratio of voltage over the distance between the weighted wire corona electrode and the collection plate. "Corona onset average electric field strength" refers to the minimum average electric field strength above which there is measurable forward corona discharge from the weighted wire corona electrodes to the collection plates. The corona onset average electric field strength and corona onset voltage are a direct function of electrode diameter and inverse function of gas temperature. The descending curve is to the right of the ascending curve and all electrical current was extinguished by the time the corona onset average electric field strength was reached. Accordingly, at 500° F. the sample demonstrated no signs of back corona discharge.

Figure 10:
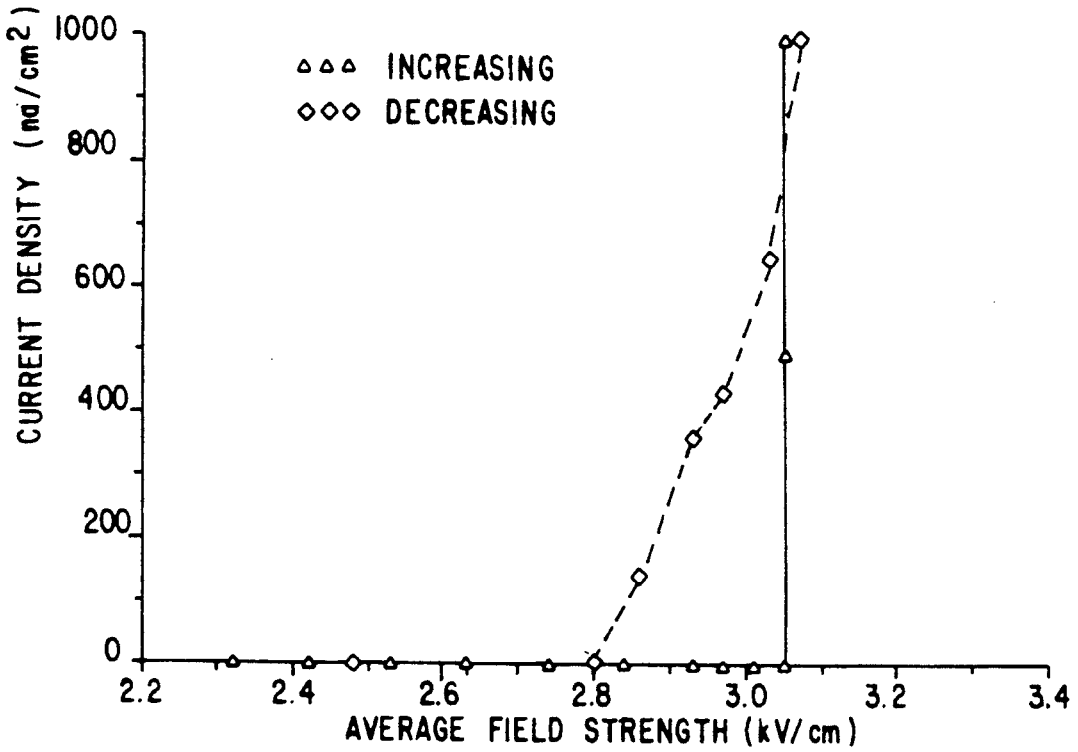
FIG. 10 is a graph showing the relationship between current density and average field strength at 450° F. and 13% moisture in a simulation test of an embodiment of the present invention operating on a fluid catalytic cracking unit at the Tosco Avon Refinery.

In contrast, FIG. 10 shows the results of a similar test conducted at 450° F. The corona onset average electric field strength was approximately 3.05 kilovolts per centimeter. The increase in corona onset average electric field strength over FIG. 10 was due to a lower temperature and resulting higher density of the gas. For average electric field strengths greater than the corona onset average electric field strength, electrical current rose vertically. The descending curve is to the left of the ascending curve at average field strengths below the average corona onset average electric field strength, which is characteristic of back corona discharge. The back corona current, or reversed flow of ions, appears as increased electrical current.

Based on these results, all of the corona electrodes in section 6 of the electrostatic precipitator were replaced with modified weighted wire corona electrodes having lower electrode sections with a diameter of $\frac{5}{8}$ inches. The top of the lower electrode sections were located opposite the point on the collection plates having a temperature of approximately 500° F. The location of this point may be determined by a number of methods known to those skilled in the art including the use of a thermocouple tree. The weighted wire corona electrode above the lower electrode section was a standard weighted wire electrode having a diameter of 1/10 inches. All of the weighted wire corona electrodes in sections 5 and 7 were replaced with new conventional weighted wire corona electrodes.

Table 3 is a comparison of the electrical operating characteristics for all sections of the electrostatic precipitator measured just after the unit was brought on line following cleaning and rewiring of the last three sections and again after one month of operation. The modified weighted wire corona electrodes in section 6 provided improved electrical operating conditions over the conventional weighted wire corona electrodes in the other sections. After a month of operation, section 6 had the highest operating voltage.

TABLE 3

Electrical Operating Conditions on the West ESP with New and Modified Wires.

| | | After Cleaning | | After One Month of Operation | |
|---|---|---|---|---|---|
| Section | Electrodes | kV | na/cm$^2$ | kV | na/cm$^2$ |
| 1 (Inlet) | Old wires | 26 | 20 | 28 | 20 |
| 2 | Old wires | 26 | 25 | 26 | 27 |
| 3 | Old wires | 27 | 38 | 22 | 38 |
| 4 | Old wires | 26 | 42 | 22 | 41 |
| 5 | New wires | 30 | 59 | 24 | 79 |
| 6 | Modified wires | 32 | 65 | 29 | 63 |
| 7 | New Wires | 33 | 67 | 25 | 67 |

Accordingly, the deterioration in electrical conditions appeared to be caused by back corona discharge in the lower areas of the collection plates. Although only small portions of the collection plates were affected, the back corona discharge was so severe that it consumed the entire capacity of the power supply and reduced the operating voltage to levels below the corona onset voltage. This significantly reduced the performance of the electrostatic precipitator.

While various embodiments of the present invention have been described in detail, it is apparent that modifications and adaptations of those embodiments will occur to those skilled in the art. However, it is to be expressly understood that such modifications and adaptations are within the scope of the present invention, as set forth in the following claims.

What is claimed:

1. An apparatus to remove particles having a temperature above the critical temperature from a gas stream comprising:

a housing;

input duct means for introducing an input gas stream into said housing;

output duct means for removing an output gas stream from said housing;

an electrostatic precipitating means, including;

a power supply having positive and negative terminals;

at least one electrode means electrically connected to said negative terminal of said power supply and positioned relative to said input gas stream in said housing to impart a charge to said particles in said input gas stream; and at least one collection means electrically connected to said positive terminal of said power supply and positioned within said housing relative to said electrode means to accumulate said charged particles on said collection means, wherein a particle layer accumulates during operation;

said electrode means and collection means defining an upper laterally extending primary operating region having a temperature substantially throughout that is greater than a first value and at least a portion with a localized electric field strength greater than a second value, and a lower laterally extending secondary operating region having a temperature substantially throughout that is less than the first value and a localized electric field strength substantially throughout that is less than the second value;

said first and second values being predetermined wherein the maximum strength of the localized electric field produced in said accumulated particle layer is less than the minimum electrical breakdown strength of the accumulated particle layer substantially throughout the primary and secondary operating regions and the maximum current density in said collection means within said primary operating region is greater than the maximum current density in said collection means within said secondary operating region; and a hopper means positioned below said electrostatic precipitating means for disposal of said charged particles removed from said collection plate.

2. An apparatus, as claimed in claim 1, wherein:

said second value is substantially equal to the minimum corona onset localized electric field strength in said secondary operating region.

3. An apparatus, as claimed in claim 1, wherein:

said primary operating region has a current density in the collection means greater than about 1.0 $nA/cm^2$; and said secondary operating region has a current density in the collection means less than about 1.0 $nA/cm^2$.

4. An apparatus, as claimed in claim 1, further comprising a plurality of sections positioned between said input duct means and said output duct means, each section extending across said input gas stream and including at least one said electrode means and at least one said collection means defining primary and secondary operating regions in each of the sections, wherein the primary and secondary operating regions are defined to be progressively smaller and larger, respectively, from said input duct means to said output duct means.

5. An apparatus, as claimed in claim 1 wherein:

a bottom end of said collection means terminates at a bottom end of said secondary operating region, and said electrode means comprises;

a first electrode portion positioned entirely within the primary operating region and having an outer surface configuration wherein the maximum localized electric field strength along the portion of said first electrode portion facing said collection means is greater than the second value; and a second electrode portion positioned entirely within the secondary operating region and having an outer surface configuration wherein the maximum localized electric field strength along the portion of said second electrode portion facing said collection means is less than the second value.

6. An apparatus, as claimed in claim 5, wherein:

said outer surface configuration of said first electrode portion is substantially cylindrical and has a first radius, wherein said localized electric field strength at any point in said primary operating region decreases with increasing distance from said electrode means and said maximum localized electric field strength is at a first radial distance from an axis coinciding with said electrode means;

said outer surface configuration of said second electrode portion is substantially cylindrical and has a second radius greater than said first radius, wherein said localized electric field strength at any point in said secondary operating region decreases with increasing distance from said electrode means and said maximum localized electric field strength is at a second radial distance from said axis; and said second radial distance is greater than said first radial distance.

7. An apparatus, as claimed in claim 6, wherein:

said first radius is substantially equal to said first radial distance; and said second radius is substantially equal to said second radial distance.

8. An apparatus, as claimed in claim 5, wherein:

said first electrode portion has at least one spike; and said second electrode portion has a substantially smooth outer surface configuration.

9. An apparatus, as claimed in claim 5, wherein:

said electrode means is a rigid frame electrode;

said first electrode portion has at least one substantially cylindrical charging section having a third radius; and said second electrode portion has at least one substantially cylindrical charging section having a fourth radius, wherein said third radius is less than said fourth radius.

10. An apparatus, as claimed in claim 5, wherein:

said outer surface configuration of said second electrode portion has at least one corner laterally extending substantially throughout said secondary operating region.

11. An apparatus, as claimed in claim 5, wherein:

said outer surface configuration of said second electrode portion has at least one curved surface laterally extending substantially throughout said secondary operating region.

12. An apparatus, as claimed in claim 1, wherein:

a bottom end of said collection means terminates at a bottom end of said secondary operating region; and a bottom end of said electrode means terminates at a bottom end of said primary operating region.

13. An apparatus, as claimed in claim 1, said first value being a predetermined temperature above which substantially all charged particles accumulated in said primary operating region have a resistivity less than about $1\times10^{11}$ ohm-centimeters, and below which substantially all charged particles accumulated in said secondary operating region have a resistivity greater than about $1\times10^{11}$ ohm-centimeters.

14. An apparatus to remove particles having a temperature above the critical temperature from a gas stream comprising:

a housing;

input duct means for introducing an input gas stream into said housing;

output duct means for removing an output gas stream from said housing;

an electrostatic precipitating means, including;

a power supply having positive and negative terminals;

at least one electrode means, having first and second electrode portions, electrically connected to said negative terminal of said power supply and positioned relative to said input gas stream in said housing to impart a charge to said particles in said input gas stream; and at least one collection means electrically connected to said positive terminal of said power supply and positioned within said housing relative to said electrode means to accumulate said charged particles on said collection means, wherein a particle layer accumulates during operation;

said first electrode portion and collection means defining an upper laterally extending primary operating region having a temperature substantially throughout that is greater than a first value and said first electrode portion having an outer surface configuration wherein the maximum localized electric field strength along said first electrode portion is greater than a second value; and said second electrode portion and collection means defining a lower laterally extending secondary operating region having a temperature substantially throughout that is less than the first value and said second electrode portion having an outer surface configuration wherein the maximum localized electric field strength along said second electrode portion is less than a second value;

said first and second values being predetermined wherein the maximum strength of the localized electric field produced in said accumulated particle layer is less than the minimum electrical breakdown strength of the accumulated particle layer substantially throughout the primary and secondary operating regions and the maximum current density in said collection means within said primary operating region is greater than the maximum current density in said collection means within said secondary operating region; and a hopper means positioned below said electrostatic precipitating means for disposal of said charged particles removed from said collection plate.

15. An apparatus, as claimed in claim 14, wherein:

said second value is substantially equal to the minimum corona onset localized electric field strength in said secondary operating region.

16. An apparatus, as claimed in claim 14, wherein:

said primary operating region has a current density in the collection means greater than about 1.0 $nA/cm^2$; and said secondary operating region has a current density in the collection means less than about 1.0 $nA/cm^2$.

17. An apparatus, as claimed in claim 14, wherein:

said outer surface configuration of said first electrode portion is substantially cylindrical and has a first radius, wherein said localized electric field strength at any point in said primary operating region decreases with increasing distance from said electrode mans and said maximum localized electric field strength is at a first radial distance from an axis coinciding with said electrode means;

said outer surface configuration of said second electrode portion is substantially cylindrical and has a second radius greater than said first radius, wherein said localized electric field strength at any point in said secondary operating region decreases with increasing distance from said electrode means and said maximum localized electric field strength is at a second radial distance from said axis; and said second radial distance is greater than said first radial distance.

18. An apparatus, as claimed in claim 17, wherein:

said first radius is substantially equal to said first radial distance; and said second radius is substantially equal to said second radial distance.

19. An apparatus, as claimed in claim 14, wherein:

said first electrode portion has at least one spike; and said second electrode portion has a substantially smooth outer surface configuration.

20. An apparatus, as claimed in claim 14, wherein:

said electrode means is a ridge frame electrode;

said first electrode portion has at least one substantially cylindrical charging section having a third radius; and said second electrode portion has at least one substantially cylindrical charging section having a fourth radius, wherein said third radius is less than said fourth radius.

21. An apparatus, as claimed in claim 14, wherein:

said outer surface configuration of said second electrode portion has at least one corner laterally extending substantially throughout said secondary operating region.

22. An apparatus, as claimed in claim 14, wherein:

said outer surface configuration of said second electrode portion has at least one curved surface laterally extending substantially throughout said secondary operating region.

23. An apparatus, as claimed in claim 14, wherein:

a bottom end of said collection means terminates at a bottom end of said secondary operating region; and a bottom end of said electrode means terminates at a bottom end of said primary operating region.

24. An apparatus, to remove particles having a temperature above the critical temperature from a gas stream comprising:

a housing;

input duct means for introducing an input gas stream into said housing;

output duct means for removing an output gas stream from said housing;

an electrostatic precipitating means, including;

a power supply having positive and negative terminals;

a plurality of sections positioned between said input duct means and said output duct means, each section extending across said input gas stream and including:

at least one electrode means electrically connected to said negative terminal of said power supply and positioned relative to said input gas stream in said housing to impart a charge to said particles in said input gas stream; and at least one collection means electrically connected to said positive terminal of said power supply and positioned within said housing relative to said electrode means to accumulate said charged particles on said collection means, wherein a particle layer accumulates during operation;

said electrode means and collection means in each of the sections defining a corresponding upper laterally extending primary operating region having a temperature substantially throughout that is greater than a first value and at least a portion with a localized electric field strength greater than a second value, and a lower laterally extending secondary operating region having a temperature substantially throughout that is less than the first value and a localized electric field strength substantially throughout that is less than the second value;

said first and second values being predetermined wherein the maximum strength of the localized electric field produced in said accumulated particle layer is less than the minimum electrical breakdown strength of the accumulated particle layer substantially throughout the corresponding primary and secondary operating regions and the maximum current density in said collection means within said corresponding primary operating region is greater than the maximum current density in said collection means within said corresponding secondary operating region;

wherein the primary and secondary operating regions of said plurality of sections are defined to be progressively smaller and larger, respectively, from said input duct means to said output duct means; and a hopper means positioned below said electrostatic precipitating means for disposal of said charged particles removed from said collection plate.

* * * * *